US006709332B2

(12) United States Patent
Adams

(10) Patent No.: US 6,709,332 B2
(45) **Date of Patent: *Mar. 23, 2004**

(54) METHOD OF PLAYING GAME AND GAMING DEVICE COMPRISING A PRIMARY GAMING UNIT AND A PINBALL-TYPE GAME

(75) Inventor: William R. Adams, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/098,303

(22) Filed: Mar. 15, 2002

(65) Prior Publication Data

US 2002/0098884 A1 Jul. 25, 2002

Related U.S. Application Data

(63) Continuation of application No. 09/270,330, filed on Mar. 16, 1999, now Pat. No. 6,358,146, which is a continuation-in-part of application No. 08/722,379, filed on Sep. 30, 1996, now Pat. No. 5,882,261.

(51) Int. Cl.[7] ..... G07F 17/34

(52) U.S. Cl. ..... 463/20; 273/143 R; 273/119 R; 273/119 A; 273/121 B; 273/138.2

(58) Field of Search ..... 273/143 R, 121 B, 273/138.1, 138.2, 274, 119 R, 119 A; 463/20

(56) References Cited

U.S. PATENT DOCUMENTS

| | | | |
|---|---|---|---|
| 3,281,149 | A | 10/1966 | Miller |
| 4,700,948 | A | 10/1987 | Okada |
| 4,805,907 | A | 2/1989 | Hagiwara |
| 4,840,375 | A | 6/1989 | Lawlor et al. |
| 4,871,171 | A | 10/1989 | Rivero |

(List continued on next page.)

FOREIGN PATENT DOCUMENTS

| | | | | |
|---|---|---|---|---|
| DE | 2938307 A1 | | 4/1981 | |
| DE | 3700861 | | 7/1988 | |
| DE | 4014477 | | 7/1991 | |
| EP | 0333338 | | 9/1989 | |
| FR | 1474617 | | 3/1967 | |
| GB | 1242298 | | 8/1971 | |
| GB | 2066991 | * | 7/1981 | ..... 273/143 R |
| GB | 2072395 A1 | | 9/1981 | |
| GB | 2083936 | | 3/1982 | |
| GB | 2084371 | | 4/1982 | |
| GB | 2096376 | | 10/1982 | |
| GB | 2153572 | | 7/1985 | |
| GB | 2170938 | | 8/1986 | |
| GB | 2182186 | | 5/1987 | |
| GB | 2191030 | | 12/1987 | |
| GB | 2201821 A1 | | 9/1988 | |
| GB | 2202984 | | 10/1989 | |
| GB | 2242300 | | 10/1991 | |
| GB | 2273384 | * | 6/1994 | ..... 273/143 R |
| GB | 2320206 | * | 6/1998 | |
| JP | 5131044 | | 5/1993 | |

OTHER PUBLICATIONS

"An Illustrated Price Guide to the 100 Most Collectible Trade Stimulators," Richards M. Bueschel, pp. 21, 29, 83, published in the United States 1978.

"Slots 1," Richard M. Bueschel, p. 136, 142, published in the United States in 1978, revised in 1981 and 1988.

"Slot Machines on Parade," Robert N. Geddes, p. 128, published in the United States in Oct., 1980.

(List continued on next page.)

*Primary Examiner*—Benjamin H. Layno
(74) *Attorney, Agent, or Firm*—Marshall, Gerstein & Borun LLP

(57) ABSTRACT

Methods of playing games and gaming devices useful with playing games comprise a gaming unit, e.g., three reels, and a vertically disposed pinball-type game.

16 Claims, 5 Drawing Sheets

U.S. PATENT DOCUMENTS

| | | | | | |
|---|---|---|---|---|---|
| 4,906,005 | A | | 3/1990 | Manabe | |
| 5,167,413 | A | | 12/1992 | Fulton | |
| 5,205,555 | A | | 4/1993 | Hamano | |
| 5,259,616 | A | | 11/1993 | Bergmann | |
| 5,342,049 | A | * | 8/1994 | Wichinsky et al. | 273/119 R |
| 5,344,145 | A | | 9/1994 | Chadwick et al. | |
| 5,486,005 | A | | 1/1996 | Neal | |
| 5,628,684 | A | | 5/1997 | Bouedec | |
| 5,695,402 | A | | 12/1997 | Stupak | |
| 5,707,285 | A | | 1/1998 | Place et al. | |
| 5,722,891 | A | | 3/1998 | Inoue | |
| 5,772,509 | A | | 6/1998 | Weiss | |
| 5,788,230 | A | * | 8/1998 | Krise et al. | 273/121 B |
| 5,823,874 | A | | 10/1998 | Adams | |
| 5,848,932 | A | | 12/1998 | Adams | |
| 5,882,261 | A | * | 3/1999 | Adams | 463/20 |
| 5,911,418 | A | | 6/1999 | Adams | |
| 6,089,978 | A | | 7/2000 | Adams | |
| 6,110,043 | A | | 8/2000 | Olsen | |
| 6,358,146 | B1 | * | 3/2002 | Adams | 463/20 |

OTHER PUBLICATIONS

Advertisement, Bally Distributing Company, "Double or Nothing," Model 1083, Chapter 11–1974–1984, p. 267.

"Slot Machines", Marshall Fey, pp. 126 and 150, published in Reno, Nevada in 1983, 2nd 1989, 3rd 1991.

"Intergame Magazine," Cover and pp. 91 and 101, published in England in Jun., 1995.

English Translation of French Patent No. 1474617.

English Translation of Japanese Patent No. 5131044.

* cited by examiner

CASH FULL
BAR
BAR
BAR

METHOD OF PLAYING GAME AND GAMING DEVICE COMPRISING A PRIMARY GAMING UNIT AND A PINBALL-TYPE GAME

RELATED APPLICATION

This is a continuation of U.S. Ser. No. 09/270,330 filed Mar. 16, 1999, now U.S. Pat. No. 6,358,146, which is incorporated herein by reference in its entirety, which is a continuation-in-part of U.S. Ser. No. 08/722,379 filed Sep. 30, 1996, now U.S. Pat. No. 5,882,261.

This is a continuation-in-part of application Ser. No. 08/722,379 filed on Sep. 30, 1996 which issued as U.S. Pat. No. 5,882,261 on Mar. 16, 1999.

The present invention is directed to methods of playing wagering games and gaming devices comprising a primary gaming unit and a pinball-type game.

BACKGROUND OF THE INVENTION

Games of chance have been enjoyed by people for thousands of years and have enjoyed widespread popularity in recent times. Many people enjoy playing a wide variety of games that they have not previously played. Playing new games adds to the excitement of this recreational activity particularly when some form of "gaming" is involved. As used herein, the term "gaming" and "gaming devices" are used to indicate that some form of wagering is involved, and that players must make wagers of value, whether actual currency or some equivalent of value, e.g., token or credit.

One popular game of chance that has long been enjoyed by many players is the slot machine. Conventionally, a slot machine is configured for a player to input something of value, e.g., a standard denomination of currency or house token or other representation of currency or credit, and then to permit the player to activate the device which causes a plurality of reels to spin and ultimately stop to display a random combination of some form of indicia, for example, numbers or symbols. If this display contains one of a preselected plurality of winning combinations, the machine releases money into a payout chute or onto a credit meter for the player. For example, if a player initially wagered two coins of a national currency and that player won a high payout, that player may receive fifty coins of the same denomination in return.

Since it is desirable to offer players games which they have not played before, it would be desirable to provide a player with new games and additional opportunities to receive winning payouts. It would be particularly desirable to provide new methods of determining the amounts of such winning payouts.

It would therefore also be desirable to provide novel payouts and events which are discernible by a player and/or other observers.

SUMMARY OF THE INVENTION

Various embodiments of the present invention comprise gaming devices having a gaming unit and a pinball-type game.

According to one embodiment of the present invention, a pinball-type game provides at least one payout solely on the basis of the outcome of the pinball-type game. In one embodiment, the pinball-type game is clearly visible to a player and is actuated when the primary gaming unit comprising a slot machine displays certain predetermined indicia. In another embodiment, the pinball-type game is actuated by some event other than the outcome of the gaming unit such as the wagering of some minimum pre-determined amount, e.g., maximum number of coins permitted for playing the primary gaming unit, a pre-determined rate of play by a player, the use of a player tracking device by a player, e.g. a casino card, or some signal generated by the gaming establishment, or a choice by the player after a pre-determined event, e.g. a player may be provided the option of receiving an award or playing the pinball-type game or waging a portion of the award on the pinball-type game. The pinball-type game is preferably operated automatically and randomly by the gaming device or may be operated by the player. As to the preferred embodiment, the outcome of the pinball-type game is not dependent on player's skill.

The gaming device may also comprise a bonus wheel or reel for increasing the score resulting from play of the pinball-type game and/or from the play of the primary gaming unit. The bonus wheel or reel can be caused to spin automatically or in response to some outcome on either the gaming unit or pinball type game.

As described in more detail below, it is within the scope of the present invention to provide a payout from the primary gaming unit only, a payout from the pinball-type game only (with or without use of a bonus wheel), and a payout from the primary gaming unit and the pinball-type game (with or without use of a bonus wheel).

According to one embodiment of the present invention, when the reels of the primary gaming unit stop on one of a predetermined plurality of winning indicia sets, the pinball-type game is placed in an active state. A person, such as the player, may actuate a pinball plunger in order to operate the pinball-type game or the pinball can be actuated automatically. According to another embodiment of the present invention, activation of play of the pinball-type game requires operator intervention so that a player must involve a casino attendant.

Still other embodiments of the present invention comprise gaming devices having electronic means for displaying indicia of rotatable reels such as a video screen, and/or means for displaying a pinball-type game such as a video screen.

The present invention also comprises methods for playing wagering games of chance. One preferred method comprises the steps of providing a player with an opportunity to place a wager, providing a gaming unit for displaying a randomly selected combination of indicia, said displayed indicia selected from the group consisting of reels, indicia of reels, indicia of playing cards, and combination thereof, providing a pinball-type game operatively connected to the gaming unit, activating said pinball-type game, and providing at least one payout based solely on the outcome of the pinball-type game.

According to the present invention, it is also within the scope of the invention to provide a gaming device having a pinball-type game which provides a payout based solely on an outcome of the pinball-type game, and also a separate payout according to the embodiments of the parent application, e.g., embodiments having a payout indicator comprising a multiplier and a value indicator, wherein a payout is indicated to a player as the product of the value shown by the value indicator and the multiplier. According to the preferred embodiments of the parent application, the value of the multiplier is determined through the operation of a pinball-type game and a rotating bonus wheel or reel before determination of the value indicator, e.g., a rotating reel. The wheel and/or reel can be caused to spin automatically or in response to some action by a player, e.g., the player pushing a button. The value indicator may be electromechanically operated and linked to a random number generator which determines where the value indicator actually stops.

DETAILED DESCRIPTION

Figure 4:
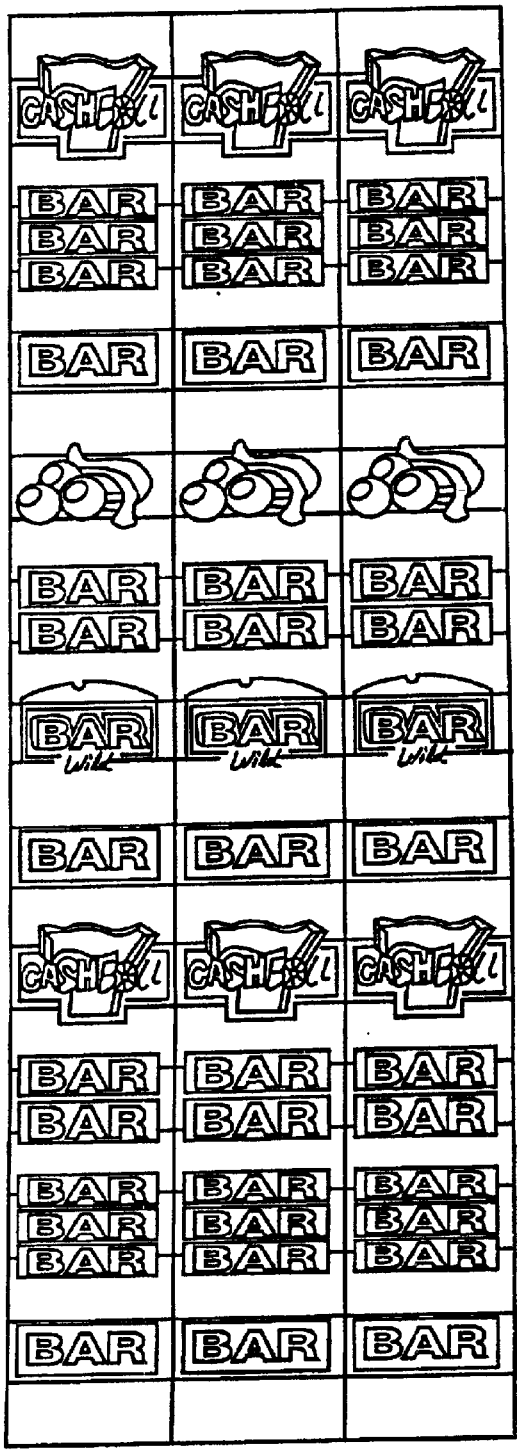
FIG. 4 illustrates the indicia utilized with the main reels shown in FIG. 3.
Figure 5:
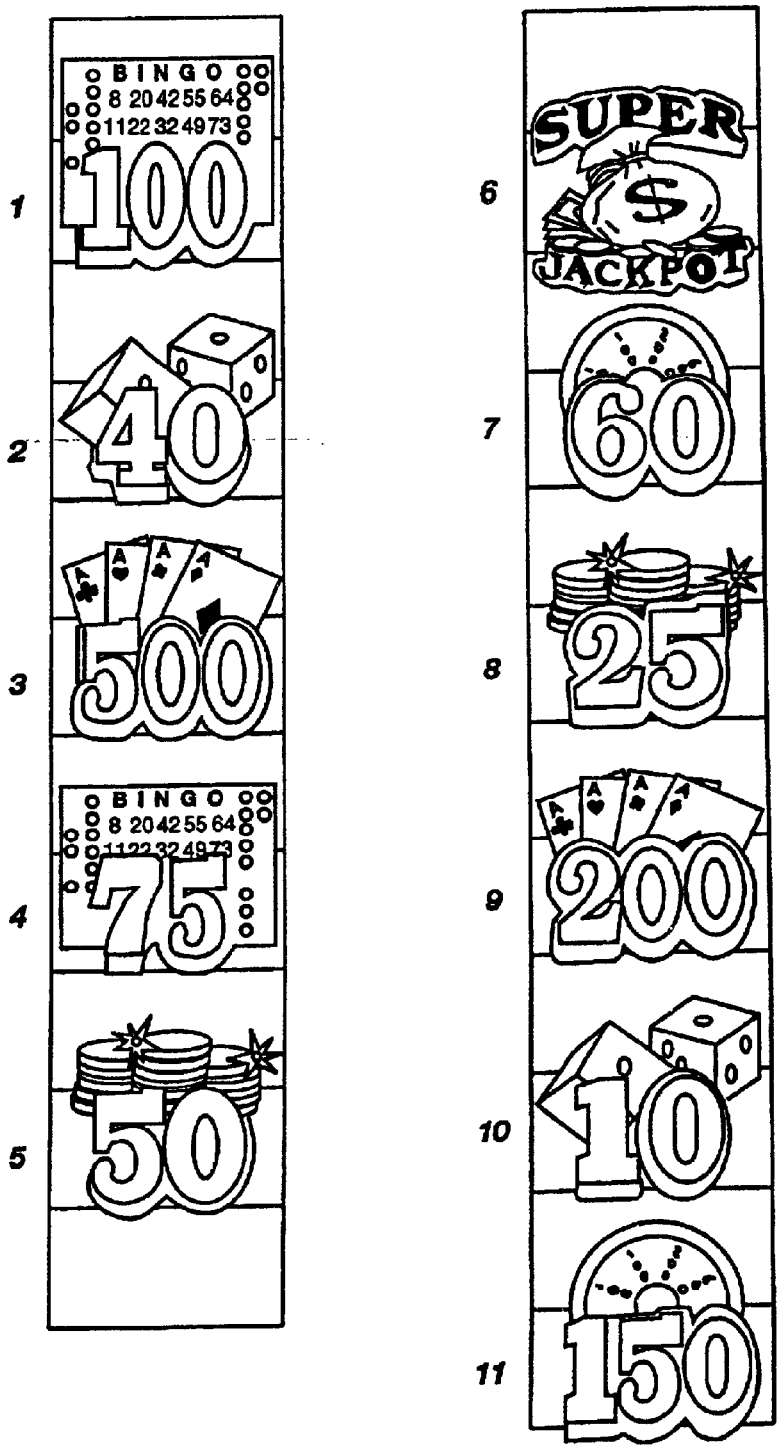
FIG. 5 illustrates the indicia of the fourth reel shown in FIG. 3.

The various embodiments of the present invention are designed to provide added excitement to a gaming device in order to increase the enjoyment to players and to serve as an added attraction to potential players. One preferred embodiment of the present invention, illustrated in FIGS. 1–5, comprises a gaming device 10 (FIG. 1) comprising a primary gaming unit 12 with three rotatable reels 11, each of which comprise a plurality of indicia (FIG. 4) on the periphery thereof, and a pinball-type game 50 (best shown in FIG. 2).

Figure 1:
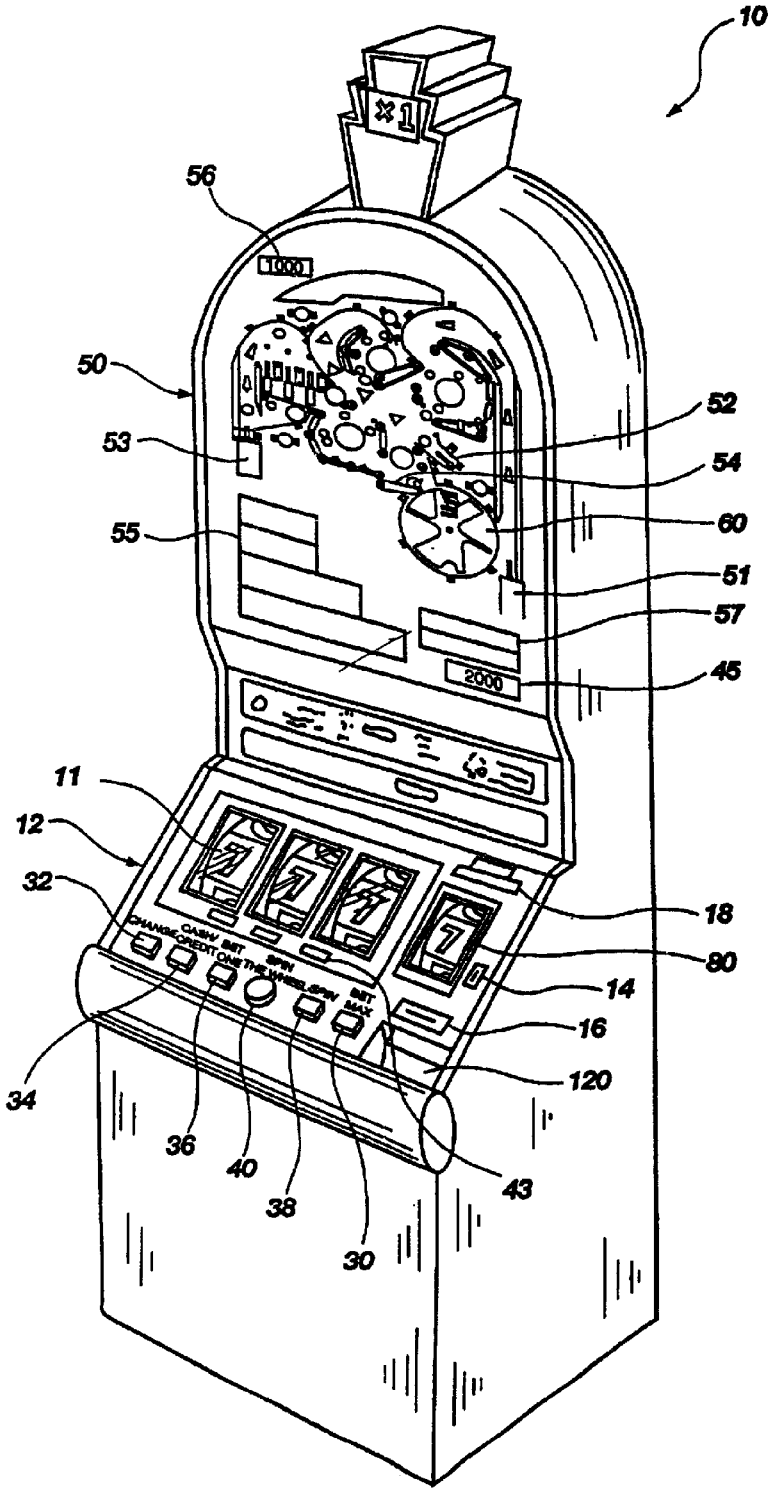
FIG. 1 is a perspective view of a gaming device of one embodiment of the present invention.

As shown in FIG. 1, this illustrated gaming device comprises a coin slot 14, currency validator 16 and a credit card validator 18. In a manner which will be recognized by those skilled in the art, each reel 11 is designed to rotate and then stop in order to visually display at least one, and preferably a number of indicia. Suitable player controls include a CHANGE button 32, a CASH/CREDIT button 34, a BET ONE button 36, and a BET MAX button 30.

If the collection of indicia displayed by reels 11 is one of a predetermined plurality of winning indicia sets, then the player can typically be provided with a winning payout either through coin chute 20 which deposits winnings into a coin trough or by increasing the player's credits in a credit window 43.

According to one aspect of the present invention, when reels 11 display a particular indicia set then pinball-type game 50 is activated and the player is provided with an opportunity for a payout based solely on pinball-type game 50. For example, primary gaming unit 12 may generate a signal in response to a particular indicia set to activate pinball-type game 50. Activation of pinball-type game 50 may also be in response to the amount wagered for play of primary gaming unit 50, e.g., a predetermined number of coins or credits, the players rate of play, a certain duration of continuous play by a player, the use of a player tracking device by a player, some other player influenced game criteria or some other signal generated by the gaming establishment which generates a signal to activate pinball-type game 50.

Figure 2:
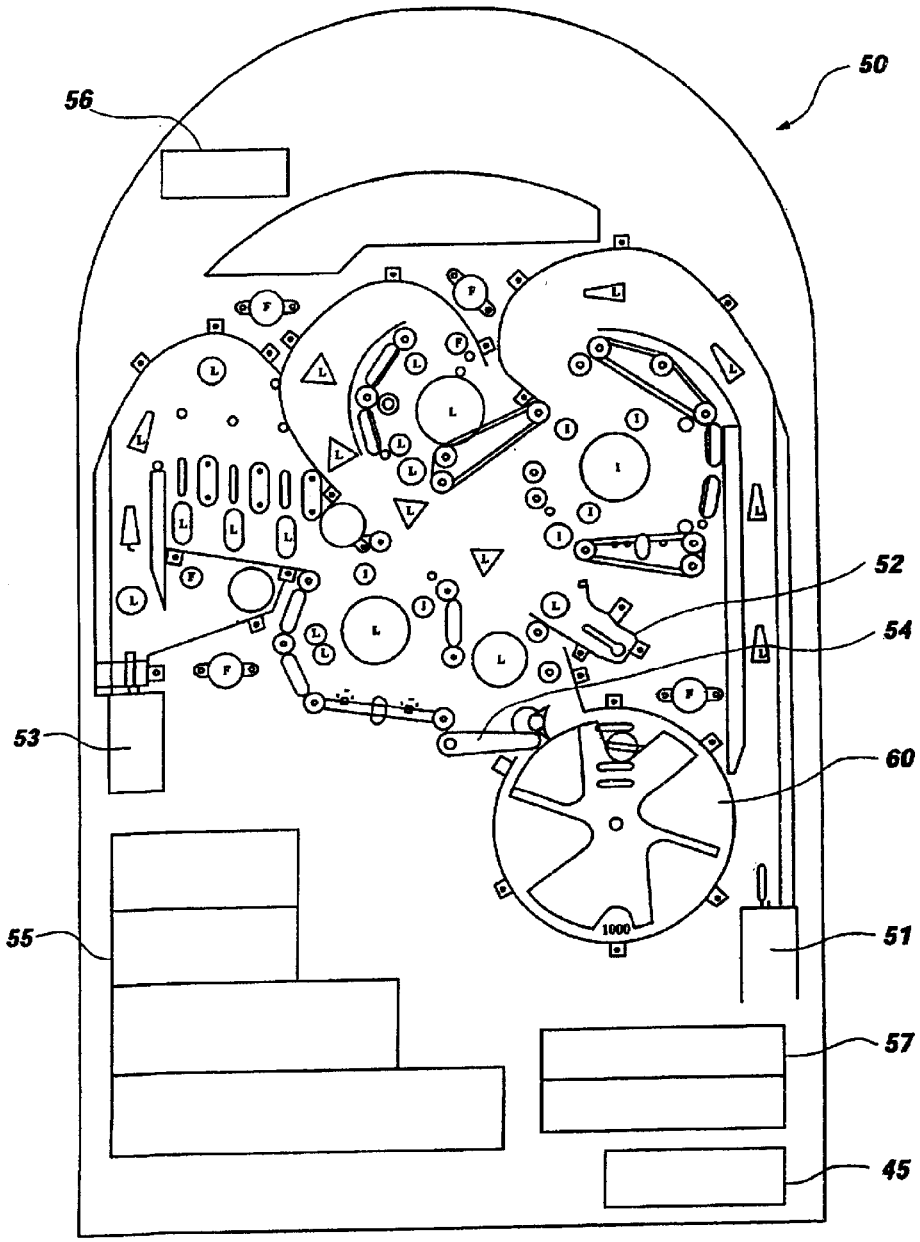
FIG. 2 is an enlarged, front elevational view of the pinball-type game of the embodiment of the present invention shown in FIG. 1.
Figure 3:
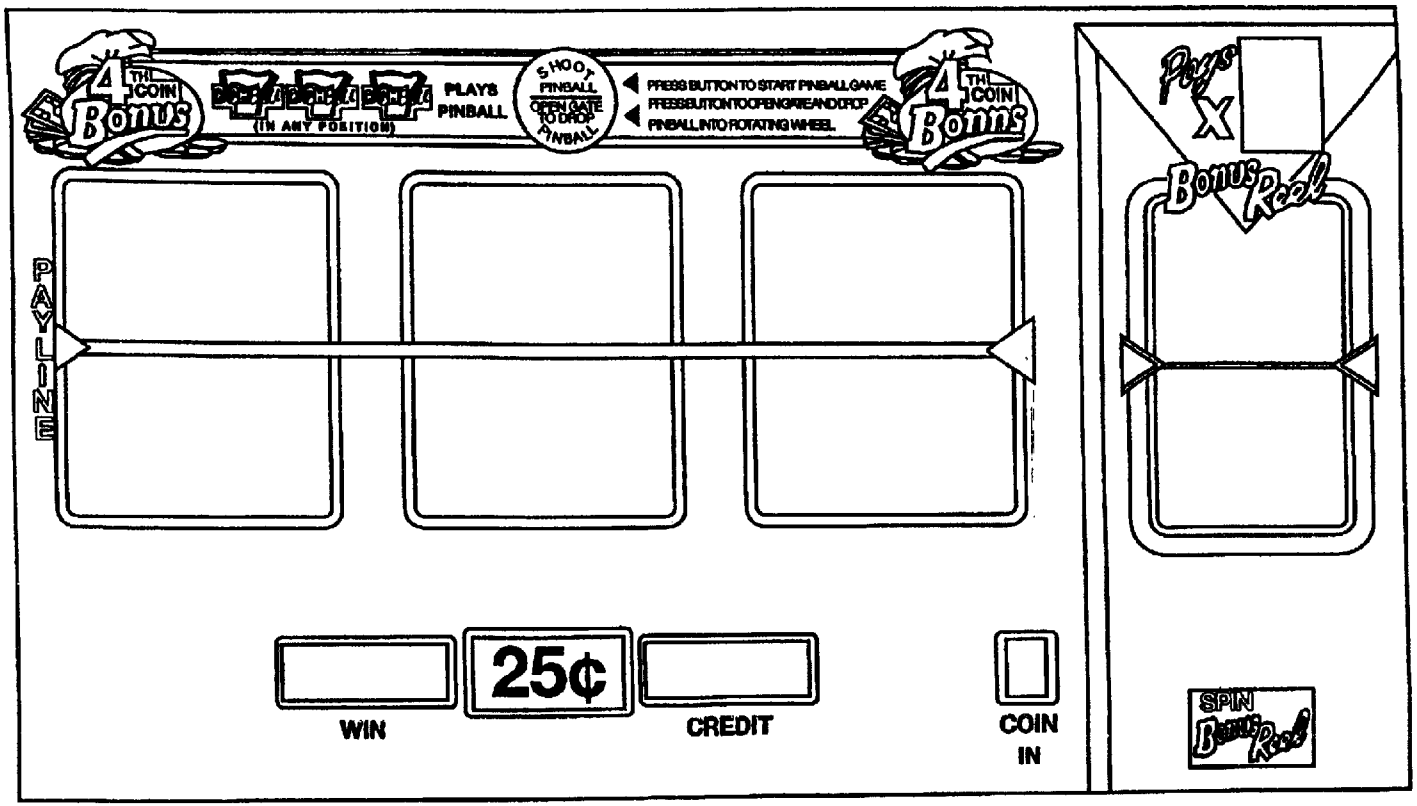
FIG. 3 is a view of the reel area of the primary gaming unit of the present invention shown in FIG. 1.

Upon activation, as best shown in FIG. 2, a pinball is placed onto a launcher 51 and the player is given a set amount of time, e.g., five seconds, to activate launcher 51, e.g., a spin/plunger actuate button 38, or launcher 51 is activated automatically. In the illustrated embodiment, a launcher sends the ball into the substantially vertical pinball-style field of bumpers and targets. The pinball bounces around and accumulates points which are indicated in point window 56 located in the upper portion of pinball-type game 50. Alternatively, a pinball can be simply released into a playing field which may or may not comprise bumpers for driving or ricocheting the ball around the field.

In this illustrated embodiment, after the ball traverses a first portion of the pinball field, the ball is ejected from a second plunger 52 and then subsequently from a third plunger 53. The illustrated embodiment also comprises an actual flipper 54 which is preferably automatically and randomly operated, or may be controlled by the player by activating a button. The player may be provided with one or more turns with a ball passing through the pinball-style field.

According to one embodiment, the total number of points from the pinball type game 50 may then be translated into a given multiplier which is then multiplied by the outcome of the primary gaming unit or by the outcome of a secondary wheel or reel. Alternatively, on the player's last ball, the ball is positioned above a rotatable bonus wheel 60. Bonus wheel 60 comprises a plurality of segments which bear designated different bonus values. A bonus value is then added to the points already accumulated in point window 56 during play of pinball-type game 50. The total point value in window 56 is then converted to a payout in accordance with payout schedule 57.

According to another embodiment of the present invention, when the reels display an indicia set which will provide play of the pinball-type game, activation of the pinball-type game requires intervention by a house attendant, such as a casino attendant. According to this embodiment of the present invention, the casino is provided with greater control over the payout of the pinball-type game and, if desired, can accompany the payout with great fanfare. It will be appreciated that the amounts of the payout indicated in the figures are merely for purposes of illustration and, if desired, the amounts can have a significantly greater value. For example, one of the areas on the payout schedule may correspond to a new automobile, a luxury vacation or a very large sum of money.

It is also within the scope of the present invention to provide a gaming device comprising a pinball-type game with non-monetary prizes or losing spaces wherein no additional prize is provided. In addition, it may be possible to provide the pinball-type game which affects the prize normally associated with the indicia shown on the primary gaming unit reels, e.g., increases or decreases the payment of the primary gaming unit.

Another embodiment of the present invention comprises providing gaming device having a pinball-type game which provides a payout based solely on the pinball-type game, and also a separate payout according to a payout indicator comprising two components. With reference to FIG. 1, the first component comprises pinball-type game 50 and the second component comprises a fourth reel 80. Pinball-type game 50 provides a multiplier which can increase the value indicated on fourth reel 80 by any desired amount, e.g., 1×, 2×, and 3×. In this illustrated embodiment, the multiplier is determined prior to the spinning of the fourth reel.

Pinball-type game 50 operates as explained above, and desirably, on the player's last ball, the ball is positioned above bonus wheel 60 for providing a bonus value. The total number of points from play of pinball-type game 50 is then converted to a multiplier as explained below.

In this illustrated embodiment, the value of the multiplier is determined by the outcome of pinball-type game 50. The possible scores that can be achieved from the pinball game are preferably listed on a payout schedule 55 in ranges with each attained range corresponding with a multiplier value, e.g., 1×, 2×, 3×, etc. For example, scores between zero and 9,999 are assigned a multiplier value of one (1×), scores from 10,000 to 19,999 are assigned a multiplier value of two (2×) and scores from 20,000 and up get a multiplier of three times (3×).

After the multiplier value, e.g., 1×, 2× or 3×, has been determined, that value is preferably displayed through a window 45 disposed above fourth reel 80. The fourth reel is then rotated and, upon stopping, indicates a base payout which is then multiplied by the multiplier and the resulting product value is awarded to the player. The player's payout can be credited to a credit meter or can be actually provided through a coin trough.

While the first component in the illustrated multiplier of the present invention in FIG. 1 is generally in the form of a pinball-type game, other randomly-controlled visible, mechanical indicia can be provided, whether controlled totally mechanically, electro-mechanically, or electronically, or any combination thereof.

When the various embodiments of the gaming device are not in use, the pinball-type game, the rotatable wheel, and/or the fourth reel can be set to an attract mode wherein a message is displayed to potential players and/or play is simulated.

Other preferred embodiments of the present invention comprise electronic gaming devices comprising a video screen or an LED display comprising an electronically generated image, e.g., a visual video display of a pinball-type game and a video display of three reels with a fourth bonus reel. While separate screens are preferred, both the reels and the pinball game indicator may be displayed on the same video screen.

The illustrated embodiment of the present invention is considered most preferable since it is believed that players prefer to see actual slot reels and an actual pinball-type game in a gaming device. Other, less preferred embodiments are also possible while providing some of the advantages of the present invention. Specifically, it is feasible to replace the spinning reels with other forms of standard gaming units, for example, a visible indicia of reels or indicia of playing cards, shown for example on a video screen. It is also possible to replace the rotatable wheel with some other discernible indicia of a mechanical bonus indicator.

What is claimed is:

1. A gaming device comprising:

a gaming unit for displaying a randomly selected combination of indicia, said displayed indicia selected from the group consisting of reels, indicia of reels, indicia of playing cards, and combinations thereof;

means for receiving at least one wager;

a randomly controlled pinball-type game operatively connected to said gaming unit;

means for activating said pinball-type game;

a payout indicator responsive to said means for activating said pinball-type game, said payout indicator comprising a value indicator and a multiplier, wherein a value of the value indicator is multiplied by a multiplier value of the multiplier to determine a payout for a player of the gaming device; and means for providing a payout responsive to said pinball-type game.

2. A gaming device according to claim 1 wherein said value indicator is a reel.

3. A gaming device according to claim 1 wherein said multiplier is linked to said pinball-type game.

4. A method of conducting a wagering game of chance comprising the steps of:

providing a player with an opportunity to place a wager;

providing a gaming unit for displaying a randomly selected combination of indicia, said displayed indicia selected from the group consisting of reels, indicia of reels, indicia of playing cards, and combination thereof;

providing a pinball-type game operatively connected to said gaming unit;

providing a payout indicator operatively connected to said gaming unit, said payout indicator comprising a value indicator and a multiplier;

multiplying a value of the value indicator by a multiplier value of the multiplier to determine a payout for a player for the wagering game:

activating said pinball-type game; and providing at least one payout responsive to the outcome of said pinball-type game.

5. A method of conducting a wagering game of chance according to claim 4 wherein said indicator comprises a reel.

6. A method of conducting a wagering game of chance according to claim 4 wherein said multiplier is responsive to said pinball-type game.

7. A method of conducting a wagering game of chance according to claim 4 wherein said indicator comprises a bonus wheel.

8. A gaming device comprising:

a gaming unit for displaying a randomly selected combination of indicia, said displayed indicia selected from the group consisting of reels, indicia of reels, indicia of playing cards, and combinations thereof;

means for receiving at least one wager;

a randomly controlled multiplier operatively connected to said gaming unit, said randomly controlled multiplier being adapted to determine a multiplier value;

a value indicator operatively connected to said gaming unit, said value indicator being adapted to determine a value;

a randomly controlled pinball-type game operatively connected to said gaming unit;

means for activating said pinball-type game; and means for providing a payout responsive to at least one of said gaming unit, said multiplier or said pinball-type game, wherein the payout is determined by multiplying the value of the value indicator by the multiplier value of the multiplier when the means for providing the payout is responsive to said multiplier.

9. An electronic gambling unit for allowing a user to play a main gambling game and a bonus round game, the electronic gambling unit comprising:

a primary game unit comprising:

a primary display mechanism capable of displaying main game symbols associated with the main gambling game, an input device that allows the user to make a plurality of input selections, wherein one of the input selections is a main game activation selection being adapted to cause the primary game unit to determine a main game outcome and display a combination of main game symbols corresponding to the outcome of the main game at the primary display mechanism when the user selects the main game activation selection a currency-accepting mechanism that is capable of allowing the user to deposit a medium of currency, and a value-dispensing mechanism that is capable of dispensing value to the user;

a secondary game unit operatively connected to the primary game unit, the secondary game unit comprising:

a secondary display mechanism capable of displaying symbols associated with the bonus round game, including symbols associated with a total point value for an occurrence of the bonus round game, and a pinball-type game being adapted to execute the bonus round game and having a plurality of bumpers each having an corresponding point value, and a ball, the pinball-type game being adapted to initiate the bonus round game upon the occurrence of a triggering event at the primary gaming unit, and wherein the total point value displayed on the secondary display mechanism is incremented by the point value corresponding to one of the bumpers when the ball impacts the one of the bumpers;

a bonus amount unit operatively connected to the primary game unit and the secondary game unit, the bonus amount unit having a plurality of bonus award amounts, one of the bonus award amounts being determined at the conclusion of an occurrence of one of the main game and the bonus round game; and a payout schedule wherein the total point value displayed on the secondary display mechanism is converted to a multiplier based on the payout schedule, and the total bonus award is determined based on multiplying the one of the bonus award amounts by the multiplier.

10. An electronic gambling unit for allowing a user to play a main gambling game and a bonus round game, the electronic gambling unit comprising:

a primary game unit comprising:

a primary display mechanism capable of displaying main game symbols associated with the main gambling game, an input device that allows the user to make a plurality of input selections, wherein one of the input selections is a main game activation selection being adapted to cause the primary game unit to determine a main game outcome and display a combination of main game symbols corresponding to the outcome of the main game at the primary display mechanism when the user selects the main game activation selection, a currency-accepting mechanism that is capable of allowing the user to deposit a medium of currency, and a value-dispensing mechanism that is capable of dispensing value to the user;

a secondary game unit operatively connected to the primary game unit, the secondary game unit comprising:

a secondary display mechanism capable of displaying symbols associated with the bonus round game, including symbols associated with a total point value for an occurrence of the bonus round game, and a pinball-type game being adapted to execute the bonus round game and having a plurality of bumpers each having an corresponding point value, and a ball, the pinball-type game being adapted to initiate the bonus round game upon the occurrence of a triggering event at the primary gaming unit, and wherein the total point value displayed on the secondary display mechanism is incremented by the point value corresponding to one of the bumpers when the ball impacts the one of the bumpers; and a bonus amount unit comprising a wheel having a plurality of segments, each segment being adapted to receive the ball of the secondary game unit and having indicia of a corresponding bonus award amount disposed on the wheel proximate the segment, wherein the ball of the secondary game unit is disposed in one of the segments of the wheel at the conclusion of an occurrence of the bonus round game, and wherein the total bonus award is determined based on the total point value and the bonus award amount corresponding to the one of the segments in which the ball is disposed.

11. The electronic gambling unit of claim 10, wherein the wheel is rotatable, and wherein the segment of the wheel in which the ball is disposed at the conclusion of an occurrence of the bonus round game is determine by the position of the wheel at the conclusion of the occurrence of the bonus round game.

12. An electronic gambling unit for allowing a user to play a main gambling game and a bonus round game, the electronic gambling unit comprising:

a primary game unit comprising:

a primary display mechanism capable of displaying main game symbols associated with the main gambling game, an input device that allows the user to make a plurality of input selections, wherein one of the input selections is a main game activation selection being adapted to cause the primary game unit to determine a main game outcome and display a combination of main game symbols corresponding to the outcome of the main game at the primary display mechanism when the user selects the main game activation selection, a currency-accepting mechanism that is capable of allowing the user to deposit a medium of currency, and a value-dispensing mechanism that is capable of dispensing value to the user:

a secondary game unit operatively connected to the primary game unit, the secondary game unit comprising:

a secondary display mechanism capable of displaying symbols associated with the bonus round game, including symbols associated with a total point value for an occurrence of the bonus round game, and a pinball-type game being adapted to execute the bonus round game and having a plurality of bumpers each having an corresponding point value, and a ball, the pinball-type game being adapted to initiate the bonus round game upon the occurrence of a triggering event at the primary gaming unit, and wherein the total point value displayed on the secondary display mechanism is incremented by the point value corresponding to one of the bumpers when the ball impacts the one of the bumpers; and a bonus amount unit operatively connected to the primary game unit and the secondary game unit, the bonus amount unit having a plurality of bonus award amounts, one of the bonus award amounts being determined at the conclusion of an occurrence of one of the main game and the bonus round game;

wherein a total bonus award is determined based on the total point value and the one of the bonus award amounts, and wherein the primary gaming unit is adapted to cause the value-dispensing mechanism to dispense the total bonus award independently of dispensing a main game award.

13. A method of determining a total bonus award at the conclusion of a bonus round game of an electronic gambling unit that allows the user to play a main gambling game and a bonus round game.

14. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, wherein the secondary game unit comprises a pinball-type game having a plurality of bumpers and a ball, each of the bumpers having a corresponding point value, and wherein the bonus amount unit comprises a wheel having a plurality of segments, each segment being adapted to receive a ball of the secondary game unit and having indicia of a corresponding bonus award amount disposed on the wheel proximate the segment, the method comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a the bonus award amount at the bonus amount unit based the one of the segments of the wheel in which the ball of the secondary game is disposed at the conclusion of an occurrence of the bonus round game; and determining the total bonus award based on the total point value and the bonus award amount corresponding to the one of the segments in which the ball is disposed.

15. The method of claim 14, wherein the wheel is rotatable, and wherein the segment of the wheel in which the ball is disposed at the conclusion of an occurrence of the bonus round game is determine by the position of the wheel at the conclusion of the occurrence of the bonus round game, the electronic gambling unit comprising a primary game unit, a secondary game unit and a bonus amount unit, and wherein the secondary game unit comprises a pinball-type game having a plurality of bumpers and a ball, each of the bumpers having a corresponding point value, the method comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit;

converting the total point value to a multiplier based on the payout schedule; and determining the total bonus award by multiplying the bonus award amount by the multiplier.

16. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, and wherein the secondary game unit comprises a pinball-type game having a plurality of bumpers and a ball, each of the bumpers having a corresponding point value, the method comprising:

executing the main gambling game:

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit;

determining the total bonus award based on the total point value and the bonus award amount; and causing the value-dispensing mechanism to dispense the total bonus award independently of dispensing a main game award.

* * * * *

UNITED STATES PATENT AND TRADEMARK OFFICE

CERTIFICATE OF CORRECTION

PATENT NO. : 6,709,332 B2
APPLICATION NO. : 10/098303
DATED : April 19, 2005
INVENTOR(S) : William R. Adams It is certified that error appears in the above-identified patent and that said Letters Patent is hereby corrected as shown below:

Claim 9
Column 6, Line 67
Please delete "selection" and insert -- selection, -- in its place.

Claim 11
Column 8, Line 18
Please delete "determine" and insert -- determined -- in its place.

Claim 12
Column 8, Line 41
Please delete "user:" and insert -- user; -- in its place.

Claims 13-15
Column 9, Line 3 through column 10, line 19
Please delete column 9, line 3 through column 10, line 19 (claims 13-15 in their entirety) and insert the following in their place:

--13. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, and wherein the secondary game unit comprises a pinball-type game having a plurality of bumpers and a ball, each of the bumpers having a corresponding point value, the method of comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit;

converting the total point value to a multiplier based on the payout schedule; and It is certified that error appears in the above-identified patent and that said Letters Patent is hereby corrected as shown below:

determining the total bonus award by multiplying the bonus award amount by the multiplier. --

--14. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, wherein the secondary game unit comprises a pinball-type game having a plurality of bumpers and a ball, each of the bumpers having a corresponding point value, and wherein the bonus amount unit comprises a wheel having a plurality of segments, each segment being adapted to receive a ball of the secondary game unit and having indicia of a corresponding bonus award amount disposed on the wheel proximate the segment, the method comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit based on the one of the segments of the wheel in which the ball of the secondary game is disposed at the conclusion of an occurrence of the bonus round game; and determining the total bonus award based on the total point value and the bonus award amount corresponding to the one of the segments in which the ball is disposed. --

UNITED STATES PATENT AND TRADEMARK OFFICE

CERTIFICATE OF CORRECTION

PATENT NO. : 6,709,332 B2
APPLICATION NO. : 10/098303
DATED : April 19, 2005
INVENTOR(S) : William R. Adams It is certified that error appears in the above-identified patent and that said Letters Patent is hereby corrected as shown below:

--15. The method of claim 63, wherein the wheel is rotatable, and wherein the segment of the wheel in which the ball is disposed at the conclusion of an occurrence of the bonus round game is determined by the position of the wheel at the conclusion of the occurrence of the bonus round game. --

Claim 16
Column 10, Line 29
Please delete "game:" and insert -- game; -- in its place.

Signed and Sealed this

Second Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 6,709,332 B2
APPLICATION NO. : 10/098303
DATED : March 23, 2004
INVENTOR(S) : William R. Adams It is certified that error appears in the above-identified patent and that said Letters Patent is hereby corrected as shown below:

Claim 9
Column 6, Line 67
Please delete "selection" and insert -- selection, -- in its place.

Claim 11
Column 8, Line 18
Please delete "determine" and insert -- determined -- in its place.

Claim 12
Column 8, Line 41
Please delete "user:" and insert -- user; -- in its place.

Claims 13-15
Column 9, Line 3 through column 10, line 19
Please delete column 9, line 3 through column 10, line 19 (claims 13-15 in their entirety) and insert the following in their place:

--13. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, and wherein the secondary game unit comprises a pinball-type game having a plurality of bumpers and a ball, each of the bumpers having a corresponding point value, the method of comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit;

converting the total point value to a multiplier based on the payout schedule; and It is certified that error appears in the above-identified patent and that said Letters Patent is hereby corrected as shown below:

determining the total bonus award by multiplying the bonus award amount by the multiplier. --

--14. A method of determining a total bonus award at the conclusion of a bonus round game of an electronic gambling unit that allows the user to play a main gambling game and a bonus round game, the electronic gambling unit comprising a primary game unit, a secondary game unit and a bonus amount unit, wherein the secondary game unit comprises a pinball-type game having a plurality of bumpers and a ball, each of the bumpers having a corresponding point value, and wherein the bonus amount unit comprises a wheel having a plurality of segments, each segment being adapted to receive a ball of the secondary game unit and having indicia of a corresponding bonus award amount disposed on the wheel proximate the segment, the method comprising:

executing the main gambling game;

determining, after execution of the main gambling game, an outcome of the main gambling game;

detecting the occurrence of a triggering event during execution of the main gambling game;

executing the bonus round game after detecting the triggering event;

incrementing a total point value for the bonus round game with the corresponding point value of one of the bumpers each time the ball impacts the bumper;

determining, after execution of the bonus round game, a bonus award amount at the bonus amount unit based on the one of the segments of the wheel in which the ball of the secondary game is disposed at the conclusion of an occurrence of the bonus round game; and determining the total bonus award based on the total point value and the bonus award amount corresponding to the one of the segments in which the ball is disposed. --

UNITED STATES PATENT AND TRADEMARK OFFICE

CERTIFICATE OF CORRECTION

PATENT NO. : 6,709,332 B2
APPLICATION NO. : 10/098303
DATED : March 23, 2004
INVENTOR(S) : William R. Adams It is certified that error appears in the above-identified patent and that said Letters Patent is hereby corrected as shown below:

--15. The method of claim 63, wherein the wheel is rotatable, and wherein the segment of the wheel in which the ball is disposed at the conclusion of an occurrence of the bonus round game is determined by the position of the wheel at the conclusion of the occurrence of the bonus round game. --

Claim 16
Column 10, Line 29
Please delete "game:" and insert -- game; -- in its place.

This certificate supersedes Certificate of Correction issued October 2, 2007.

Signed and Sealed this

Thirtieth Day of October, 2007

JON W. DUDAS
*Director of the United States Patent and Trademark Office*